US010266235B1

(12) United States Patent
Sliker

(10) Patent No.: US 10,266,235 B1
(45) Date of Patent: Apr. 23, 2019

(54) MODULAR BOAT SEATING

(71) Applicant: Sliker Design LLC, Hewitt, NJ (US)

(72) Inventor: Larry Sliker, Punta Gorda, FL (US)

( * ) Notice: Subject to any disclaimer, the term of this patent is extended or adjusted under 35 U.S.C. 154(b) by 0 days.

(21) Appl. No.: 15/898,190

(22) Filed: Feb. 15, 2018

Related U.S. Application Data

(60) Provisional application No. 62/463,881, filed on Feb. 27, 2017.

(51) Int. Cl.
*B63B 17/00* (2006.01)
*B63B 29/06* (2006.01)
*B63B 29/04* (2006.01)

(52) U.S. Cl.
CPC ..... *B63B 29/06* (2013.01); *B63B 2029/043* (2013.01); *B63B 2709/00* (2013.01)

(58) Field of Classification Search
CPC ..... B63B 29/06; B63B 2029/043; B63B 2709/00
USPC ..... 114/363
See application file for complete search history.

(56) References Cited

U.S. PATENT DOCUMENTS 4,469,377 A 9/1984 O'Rourke
4,914,772 A 4/1990 Difloe
6,428,105 B1 8/2002 Ellis et al.
6,491,558 B1 * 12/2002 Myers ..... B63B 7/082 441/130
6,561,580 B1 5/2003 Bergey
6,983,716 B1 * 1/2006 Ankney ..... B63B 17/02 114/361
7,837,273 B1 11/2010 Ratza et al.
7,913,637 B2 3/2011 Roehm, II et al.
7,984,952 B2 7/2011 Begin et al.
8,590,478 B2 * 11/2013 Lipman ..... B63B 35/79 114/347
8,869,731 B2 * 10/2014 Dow ..... B63B 29/04 114/347
9,126,519 B2 9/2015 Uebelacker
2002/0129756 A1 * 9/2002 Myers ..... B63B 1/121 114/354
2008/0236471 A1 * 10/2008 Mott ..... B63B 35/71 114/347
2009/0038526 A1 * 2/2009 Walton ..... B63B 29/04 114/347
2013/0239873 A1 * 9/2013 Dow ..... B63B 29/04 114/363
2015/0274263 A1 * 10/2015 Nutz ..... B60N 2/1605 114/363
2016/0023726 A1 * 1/2016 Ketterman ..... B63B 35/71 114/347

(Continued)

*Primary Examiner* — Daniel V Venne
(74) *Attorney, Agent, or Firm* — Thomas M. Joseph, Esq.

(57) ABSTRACT

A pontoon boat includes a pair of pontoons, a deck positioned above the pontoons, and a plurality of modular boat seats on the deck. Each modular boat seat has a frame, an upper support structure, a lower support structure, and a pair of attachment mechanisms. The frame includes a pair of vertical members and plurality of connecting members with the connecting members attaching to the vertical members to form the frame. The upper support structure and the lower support structure include outdoor sling mesh fabric. The pair of attachment mechanisms connect the upper support structure and the lower support structure to vertical members to connect the upper support structure and the lower support structure to the frame.

12 Claims, 6 Drawing Sheets

(56) References Cited

U.S. PATENT DOCUMENTS

| | | | | |
|---|---|---|---|---|
| 2017/0043842 | A1* | 2/2017 | Borden, Jr. | B63B 29/04 |
| 2018/0001973 | A1* | 1/2018 | Boyer | B63B 35/71 |

* cited by examiner

MODULAR BOAT SEATING

CROSS REFERENCE TO RELATED APPLICATION

This application claims the benefit under 35 U.S.C. § 119(e) of U.S. Provisional Application No. 62/463,881 entitled "MODULAR BOAT SEATING" filed Feb. 27, 2017, which is incorporated herein by reference.

BACKGROUND

Boat seats that are designed for open air activities are exposed to widely varying weather conditions with virtually no protection. In some cases, the boats must face these conditions even when they are not in use. These conditions place high demands upon the strength, durability, and environmental sustainability of such boat seats.

Additionally, the design of boat seats can be complicated and expensive due to the need for comfortable seats that must be used for long periods of time. This is especially true when the boat seats are designed for open air activities and/or during leisure time. Even when such boats are used for short periods of time, users expect a minimum degree of sitting comfort. Since boat seats are used in private, recreational activities, it is preferable that the boats are as inexpensive as possible. Similarly, simplicity in design is preferred without losing quality.

Moreover, existing boat seats are made, typically, from plywood and foam. These existing boat seats can include "cut and sew" cushions that look great when they are new, but are not durable. Such seats can absorb water like sponges when they get wet, which occurs frequently and in most operating environments. Wet boat seats can become moldy and/or discolored, can have water run into the seams, or can attract rodents that can eat and nest in the cushions. The fabrics that are used in such boat seats can degrade and crack in bright sunlight. As a result, there is a need for an improved boat seat.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, an apparatus comprises a modular boat seat having a frame, an upper support structure, a lower support structure, and a pair of attachment mechanisms. The frame includes a pair of vertical members and plurality of connecting members with the connecting members attaching to the vertical members to form the frame. The upper support structure and the lower support structure includes outdoor sling mesh fabric. The pair of attachment mechanisms connect the upper support structure and the lower support structure to vertical members to connect the upper support structure and the lower support structure to the frame.

In other implementations a pontoon boat includes a pair of pontoons, a deck positioned above the pontoons, and a plurality of modular boat seats on the deck. Each modular boat seat has a frame, an upper support structure, a lower support structure, and a pair of attachment mechanisms. The frame includes a pair of vertical members and plurality of connecting members with the connecting members attaching to the vertical members to form the frame. The upper support structure and the lower support structure include outdoor sling mesh fabric. The pair of attachment mechanisms connect the upper support structure and the lower support structure to vertical members to connect the upper support structure and the lower support structure to the frame.

These and other features and advantages will be apparent from a reading of the following detailed description and a review of the appended drawings. It is to be understood that the foregoing summary, the following detailed description and the appended drawings are explanatory only and are not restrictive of various aspects as claimed.

DETAILED DESCRIPTION

The subject disclosure is directed to new and improved modular boat seating that can be used in various types of commercial and recreational watercraft, such as pontoon boats. Specifically, the modular boat seating has many of the desirable properties of stationary outdoor patio furniture, which can dry, almost instantly, upon exposure to water. Such furniture can last for many seasons and requires little maintenance, other than power washing in the beginning of the season. Various fabrics are used in such furniture, including solution-dyed acrylics, acrylic-coated polyesters, olefins, canvas, and outdoor sling mesh fabric. Outdoor sling mesh fabric can be particularly adapted for use in outdoor boat seats.

The detailed description provided below in connection with the appended drawings is intended as a description of examples and is not intended to represent the only forms in which the present examples can be constructed or utilized. The description sets forth functions of the examples and sequences of steps for constructing and operating the examples. However, the same or equivalent functions and sequences can be accomplished by different examples.

References to "one embodiment," "an embodiment," "an example embodiment," "one implementation," "an implementation," "one example," "an example" and the like, indicate that the described embodiment, implementation or example can include a particular feature, structure or characteristic, but every embodiment, implementation or example can not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic can be implemented in connection with other embodiments, implementations or examples whether or not explicitly described.

Numerous specific details are set forth in order to provide a thorough understanding of one or more embodiments of the described subject matter. It is to be appreciated, however, that such embodiments can be practiced without these specific details.

Various features of the subject disclosure are now described in more detail with reference to the drawings, wherein like numerals generally refer to like or corresponding elements throughout. The drawings and detailed description are not intended to limit the claimed subject matter to the particular form described. Rather, the intention is to cover all modifications, equivalents and alternatives falling within the spirit and scope of the claimed subject matter.

Figure 1:
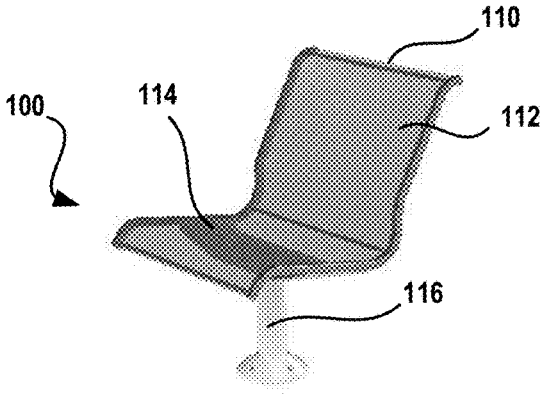
FIG. 1 is a perspective view of a boat seat that illustrates an embodiment of the invention.

Referring to the drawings and, particularly, to FIG. 1, there is shown a modular boat seat, generally designated by the numeral 100, that is adapted for implementation in outdoor boats and, specifically, in pontoon boats. The modular boat seat 100 includes a frame 110, an upper support structure 112, a lower support structure 114, and a supporting member or post 116. In this exemplary embodiment, the upper support structure 112 and the lower support structure 114 are made from outdoor sling mesh fabric to enhance comfort, "breeziness", and durability, as well as to promote the circulation of air therethrough.

The outdoor sling mesh fabric can be mounted and held within the frame without the need of additional cushioning to produce a modular boat seat 100 that is more comfortable, without, necessarily, being softer. The rigidity of the outdoor sling mesh fabric allows the upper support structure 112 and the lower support structure 114 to be mounted within the frame 110 at an open angle. The rigidity of the outdoor sling mesh fabric also allows the upper support structure 112 and the lower support structure 114 to maintain their shapes, even when they are not subject to external forces.

The outdoor sling mesh fabric is similar to PVC-coated fabric mesh or mesh network that can be used in static outdoor patio furniture due to its ability to shed water and dirt. The use of outdoor sling mesh fabric allows the upper support structure 112 and the lower support structure 114 to support the weight of a person, when the person sits thereon. As a result, the load from the person does not need to be transferred to the frame 110.

The outdoor sling mesh fabric in the upper support structure 112 and in the lower support structure 114 is not stretched in tension over the frame 110. Rather, the outdoor sling mesh fabric forms a mesh or network that has sufficient rigidity to support persons sitting thereon. The outdoor sling mesh fabric can be made from a plurality of PVC-coated synthetic fibers, including polyesters, acrylics, olefins, PVCs, or a combination thereof. The fabrics can be available in a wide variety of colors and prints.

Due to the use of outdoor sling mesh fabric, the upper support structure 112 and lower support structure 114 can be fast-drying, as compared to "cut and sew" fabrics. The outdoor sling mesh fabric dries quickly without fading. In particular, the outdoor sling mesh fabric allows the modular boat seat 100 to be pressure washed.

Figure 2:
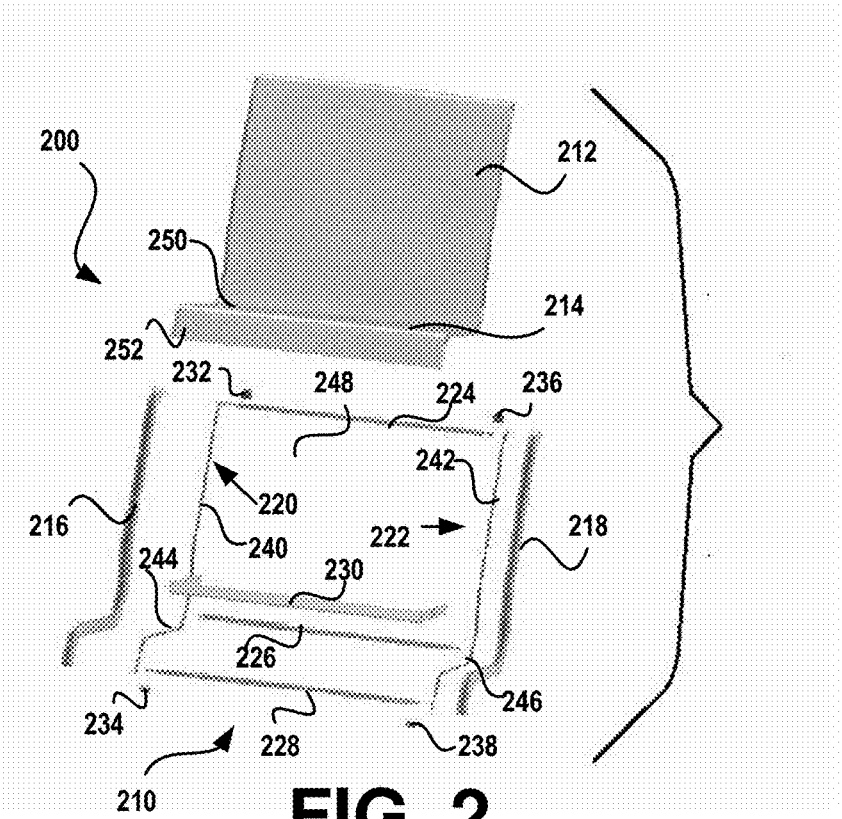
FIG. 2 is an exploded perspective view of a boat seat that illustrates another embodiment of the invention.

Referring to FIG. 2 with continuing reference to the foregoing figure, there is shown a modular boat seat assembly, generally designated by the numeral 200, which can be used to form the modular boat seat 100 shown in FIG. 1. Like the modular boat seat 100 shown in FIG. 1, the modular boat seat assembly 200 includes a frame 210, an upper support structure 212, and a lower support structure 214. Unlike the modular boat seat 100 shown in FIG. 1, the modular boat seat assembly 200 does not include supporting member or post 116 shown in FIG. 1.

The modular boat seat assembly 200 includes a pair of vertically-aligned attachment mechanisms 216-218. The frame 210 includes a pair of vertical members 220-222, a plurality of connecting members 224-228, a bracket 230, and a plurality of extrusion end caps 232-238. The connecting members 224-228 join the vertical members 220-222 to form the frame 210. In this exemplary embodiment, the connecting members 224-228 are spreader bars. The vertical members 220-222 are curved, extruded members.

The attachment mechanisms 216-218 connect the upper support structure 212 and the lower support structure 214 to vertical members 220-222 to connect the upper support structure 212 and the lower support structure 214 to the frame 210. The attachment mechanisms 216-218 can be piping and/or sling rails.

The vertical members 220-222, the connecting members 224-228, the bracket 230, and the extrusion end caps 232-238 can be made from any suitable material through any suitable manufacturing method. Suitable materials include flexible, semi-flexible, rigid, or semi-rigid materials. Suitable materials also include metals, ceramics, plastics, and composites. The term "semi-rigid" is a term of degree referring to materials that are stiff and solid, but not inflexible.

It should be understood that each component of the frame 210 can be made of a material that is specifically suited for the individual structural tolerances. Any combination of material or a uniform application of a single material that results in an acceptably robust structure is suitable. In this exemplary embodiment, the vertical members 220-222, the connecting members 224-228, and the bracket 230 are made from metal. The extrusion end caps 232-238 are made from plastic. The vertical members 220-224 can be made from extruded aluminum.

As shown in FIG. 2, each vertical member 220-222 includes an elongated, essentially straight upper portion 240-242 and a curved, lower portion 244-246. The upper portions 240-242 and the connecting members 224-226 form a plane 248 that receives the upper support structure 212. The bracket 230 is an open-ended, essentially rectangular structure the projects essentially perpendicularly from the plane 248.

The bracket 230 can connect to the connecting member 226 to receive a portion of the lower support structure 214 to form a base or seat 250. The remainder of the lower support structure 214 hangs over the bracket 230 to form a flange 252.

Figure 3:
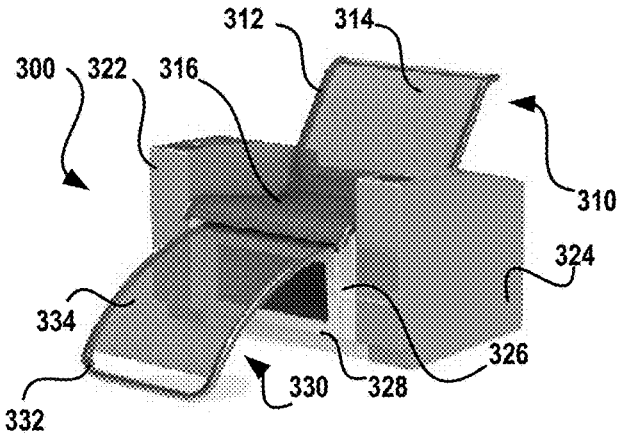
FIG. 3 is a perspective view of a boat seat that illustrates an embodiment of the invention.
Figure 4:
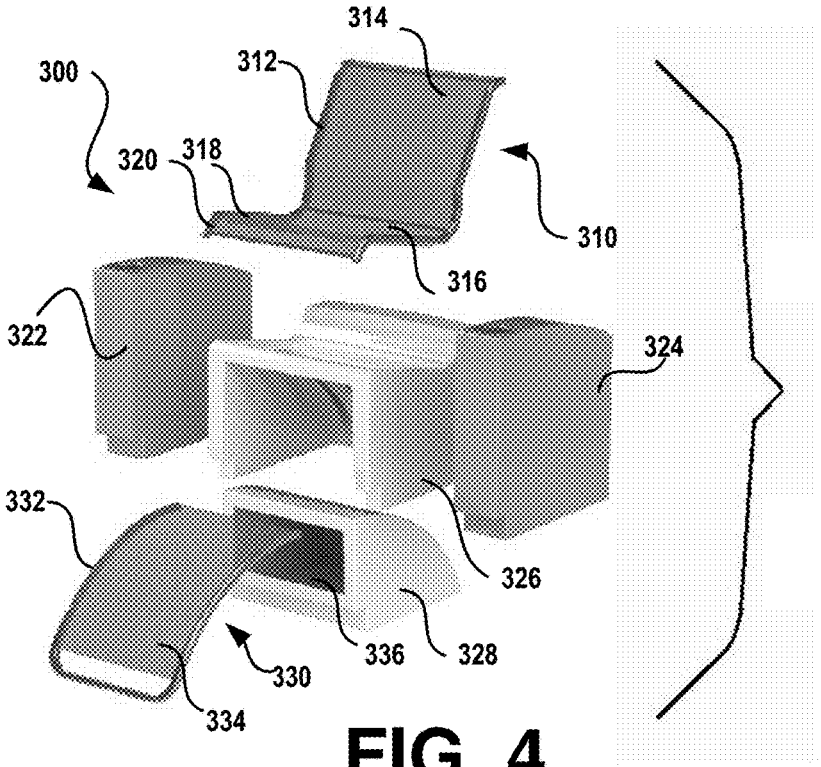
FIG. 4 is an exploded perspective view of a boat seat that illustrates another embodiment of the invention.

Referring to FIGS. 3-4 with continuing reference to the foregoing figures, there is shown another embodiment of a modular boat seat, generally designated by the numeral 300, that is adapted for implementation in outdoor boats and, specifically, in pontoon boats. The modular boat seat 300 includes a modular boat seat assembly 310 that is similar to the modular boat seat assembly 200 shown in FIG. 2.

The modular boat seat assembly 310 includes a frame 312, an upper support structure 314, and a lower support structure 316. The lower support structure 316 is divided into a seat 318 and a flange 320.

Unlike the modular boat seat 100 shown in FIG. 1, the modular boat seat 300 does not include a support member or post 116. The modular boat 300 also includes a pair of armrests 322-324, a seat support 326, and a compartment 328. Optionally, the modular boat seat 300 includes a footrest 330 that can be pivotally or rigidly connected to the flange 320.

The armrests 322-324, the seat support 326, and the compartment 328 can be made from any suitable material through any suitable manufacturing method. Suitable materials include flexible, semi-flexible, rigid, or semi-rigid materials. Suitable materials also include metals, ceramics, plastics, and composites. In this exemplary embodiment, the armrests 322-324, the seat support 326, and the compartment 328 are made from plastic and are formed through rotational molding or rotomolding to reduce tooling costs.

The use of a rotomolding process to form the armrests 322-324, the seat support 326, and the compartment 328 produces durable, plastic components that are more durable than plywood and are resistant to rotting or to mildew when left uncovered. The molding process further reduces rot and mildew by producing structures that do not have horizontal joints, which are prone to leakage.

The armrests 322-324, the seat support 326, and the compartment 328 can be formed from relatively inexpensive olefins or from other commodity plastics. The armrests 322-324, the seat support 326, and the compartment 328 can include additives that include UV stabilizers or a PVC coating.

As shown in FIGS. 3-4, the footrest 330 includes a frame 332 and foot support structure 334. In this exemplary embodiment, the frame 332 is formed from the same materials and in a similar manner as the frame 312. The foot support structure 334 is formed from the same materials and in a similar manner as the upper support structure 314 and lower support structure 316. The footrest 330 can be detached from the flange 320 for storage in a chamber 336 within the compartment 328.

Figure 5:
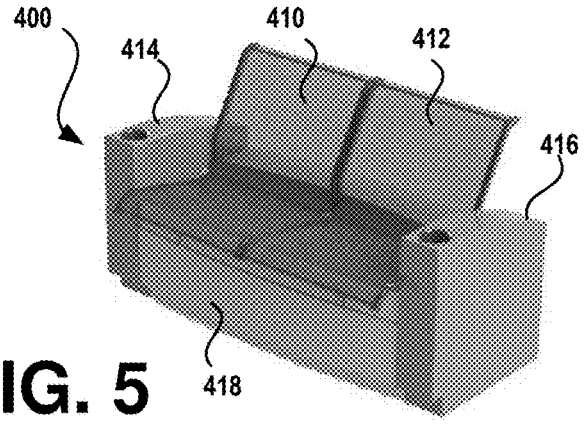
FIG. 5 is a perspective view of a boat seat that illustrates an embodiment of the invention.
Figure 6:
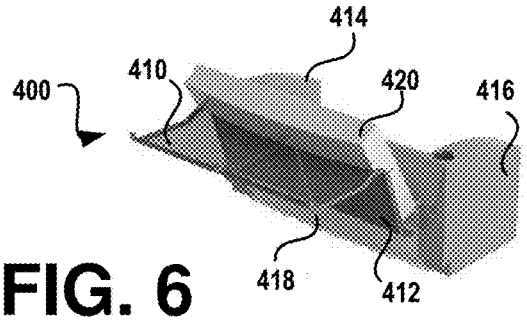
FIG. 6 is a perspective view of a boat seat that illustrates an embodiment of the invention.
Figure 7:
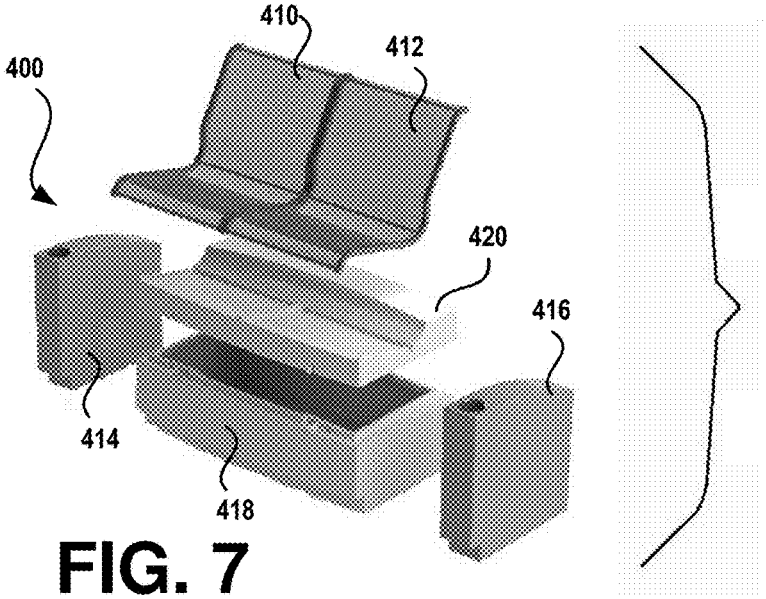
FIG. 7 is an exploded perspective view of a boat seat that illustrates another embodiment of the invention.

Referring to FIGS. 5-7 with continuing reference to the foregoing figures, there is shown another embodiment of a modular boat seat, generally designated by the numeral 400, that is adapted for implementation in outdoor boats and, specifically, in pontoon boats. Unlike the embodiments shown in FIGS. 1-4, the modular boat seat 400 includes a pair of boat seat assemblies 410-412, so that the modular boat seat 400 is a double seat.

The modular boat seat 400 includes a pair of armrests 414-416 that is similar in structure and construction to the pair of armrests 322-324 shown in FIGS. 3-4. The modular boat seat 400 also includes a storage box 418 and a waterproof lid 420.

The storage box 418 and the lid 420 can be made from any suitable material through any suitable manufacturing method. Suitable materials include flexible, semi-flexible, rigid, or semi-rigid materials. Suitable materials also include metals, ceramics, plastics, and composites. In this exemplary embodiment, the storage box 418 and the lid 420 are made from plastic and are formed through rotational molding or rotomolding to reduce tooling costs.

As shown in FIG. 6, the lid 420 can be connected, pivotally, to the storage box 418 to provide access to the interior of the storage box 418. When the lid 420 is connected, pivotally, to the storage box 418, the lid 420 can be rotated from a closed configuration to an open configuration and vice versa.

Figure 8:
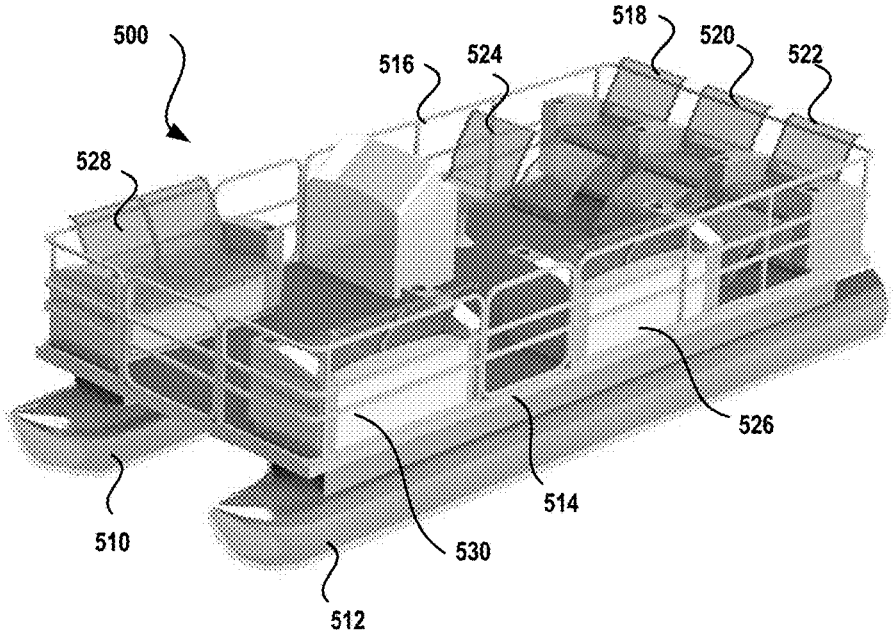
FIG. 8 is a perspective view of a boat that illustrates an embodiment of the invention.
Figure 9:
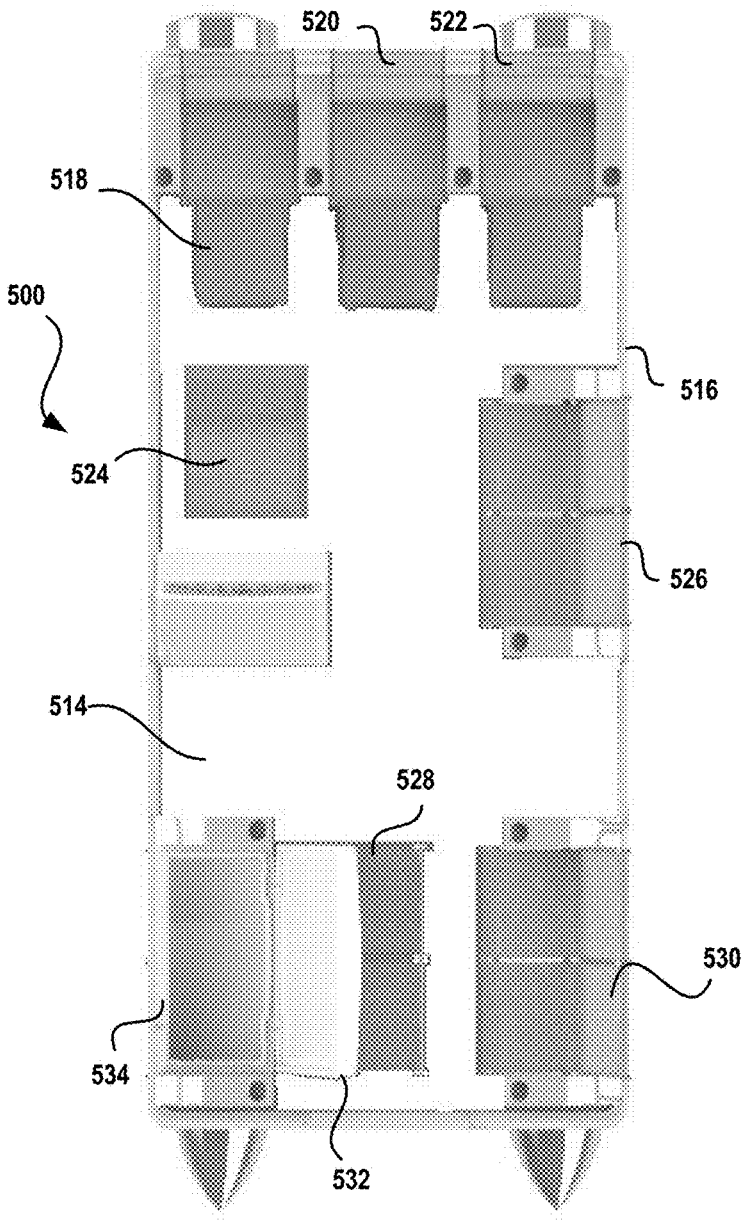
FIG. 9 is a top plan view of a boat that illustrates another embodiment of the invention.

Referring to FIGS. 8-9 with continuing reference to the foregoing figures, there is shown a boat, generally designated by the numeral 500. The boat 500 has floats 510-512. While boat 500 can be described and is depicted herein as a pontoon boat, boat 500 may be any type of boat, such as a deck boat. Deck 514 of pontoon boat 500 is positioned upon floats 510-512, which provide sufficient buoyancy to keep deck 514 above water (not shown). Substantially enclosing a portion of deck 514 is railing 516.

Positioned within the railing 516 are a plurality of modular boat seats 518-530. Modular boat seats 518-522 are substantially identical to modular boat seat 300 shown in FIGS. 3-4. Modular boat seat 524 is substantially identical to modular boat seat 100 shown in FIG. 1. Modular boat seats 526-530 are substantially identical to modular boat seat 400 shown in FIGS. 5-7. As shown in FIG. 9, modular boat seat 528 is in an open configuration with lid 532 having been moved, pivotally, to reveal the storage box 534.

Exemplary Processes

Figure 10:
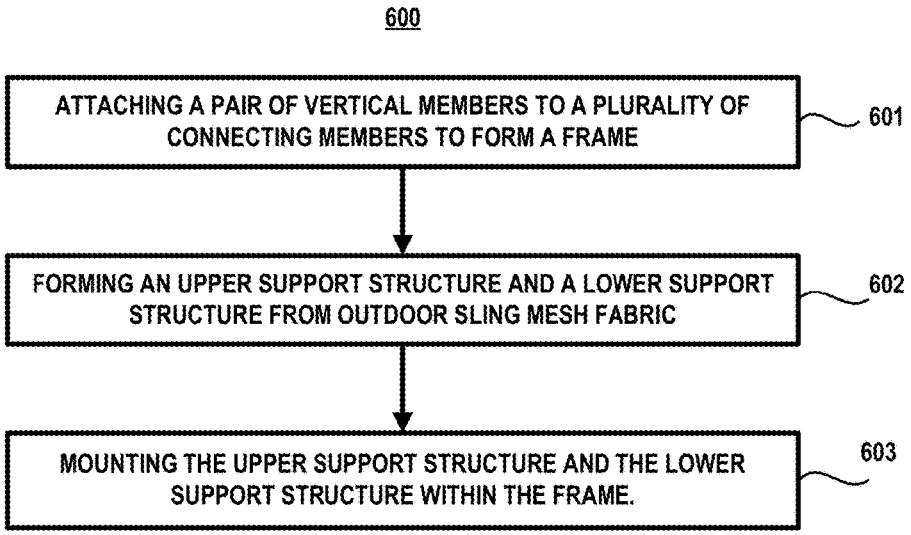
FIG. 10 illustrates an embodiment of an exemplary process in accordance with the described subject matter.

Referring to FIG. 10 with continuing reference to the foregoing figures, a method 600 for assembling the exemplary modular boat seat in accordance with features of the described subject matter is shown. Method 600, or portions thereof, can be performed to assemble the exemplary modular boat seat thereof in various embodiments. For example, method 600 can be performed to assemble the modular boat seat 100 shown in FIG. 1.

At 601, a pair of vertical members is attached to a plurality of connecting members to form a frame. In this exemplary embodiment, the vertical members can be the vertical members 220-222 shown in FIG. 2. The frame can be the frame 210 shown in FIG. 2.

At 602, an upper support structure and a lower support structure is formed from outdoor sling mesh fabric. In this exemplary embodiment, the upper support structure can be the upper support structure 212 shown in FIG. 2. The lower support structure can be the lower support structure 214 shown in FIG. 2. The outdoor sling mesh fabric can be a fabric that forms a mesh or network that has sufficient rigidity to support persons sitting thereon. The outdoor sling mesh fabric can be made from a plurality of PVC-coated synthetic fibers, including polyesters, acrylics, olefins, PVCs, or a combination thereof.

At 603, the upper support structure and the lower support structure is mounted within the frame. In this exemplary embodiment, the vertical members can be the vertical members 220-222 shown in FIG. 2. The frame can be the frame 210 shown in FIG. 2.

Supported Features and Embodiments

The detailed description provided above in connection with the appended drawings explicitly describes and supports various features of a modular boat seat. By way of illustration and not limitation, supported embodiments include an apparatus comprising: a modular boat seat having a frame, an upper support structure, a lower support structure, and a pair of attachment mechanisms, wherein the frame includes a pair of vertical members and plurality of connecting members with the connecting members attaching to the vertical members to form the frame, wherein the upper support structure and the lower support structure include outdoor sling mesh fabric, and wherein the pair of attachment mechanisms connect the upper support structure and the lower support structure to vertical members to connect the upper support structure and the lower support structure to the frame.

Supported embodiments include the foregoing apparatus, wherein the modular boat seat is a pontoon boat seat.

Supported embodiments include any of the foregoing apparatuses, wherein the rigidity of the outdoor sling mesh fabric ranges from semi-rigid to rigid.

Supported embodiments include any of the foregoing apparatuses, wherein the outdoor sling mesh fabric is made from a plurality of PVC-coated synthetic fibers.

Supported embodiments include any of the foregoing apparatuses, wherein the synthetic fibers include at least one of a polyester fiber, an acrylic fiber, an olefin fiber, or a PVC fiber.

Supported embodiments include any of the foregoing apparatuses, wherein the vertical members are made from metal and the connecting members are spreader bars.

Supported embodiments include any of the foregoing apparatuses, wherein the vertical members are extruded aluminum members.

Supported embodiments include any of the foregoing apparatuses, further comprising a pair of molded armrests.

Supported embodiments include any of the foregoing apparatuses, further comprising a storage box.

Supported embodiments include any of the foregoing apparatuses, further comprising a footrest.

Supported embodiments include any of the foregoing apparatuses, further comprising a support structure having an internal compartment for storing the footrest.

Supported embodiments include a system, a method and/or means for implementing any of the foregoing apparatuses or portions thereof.

Supported embodiments include a pontoon boat comprising: a pair of pontoons, a deck positioned above the pontoons, and a plurality of modular boat seats on the deck, wherein each modular boat seat has a frame, an upper support structure, a lower support structure, and a pair of attachment mechanisms, wherein the frame includes a pair of vertical members and plurality of connecting members with the connecting members attaching to the vertical members to form the frame, wherein the upper support structure and the lower support structure include outdoor sling mesh fabric, and wherein the pair of attachment mechanisms connect the upper support structure and the lower support structure to vertical members to connect the upper support structure and the lower support structure to the frame.

Supported embodiments include the foregoing pontoon boat, wherein the outdoor sling mesh fabric is made from a plurality of PVC-coated synthetic fibers including at least one of a polyester fiber, an acrylic fiber, an olefin fiber, or a PVC fiber.

Supported embodiments include any of the foregoing pontoon boats, wherein at least one of the modular boat seats includes a pair of molded armrests.

Supported embodiments include any of the foregoing pontoon boats, wherein the pair of molded armrests are rotationally molded armrests.

Supported embodiments include any of the foregoing pontoon boats, wherein at least one of the modular boat seats includes a storage box.

Supported embodiments include any of the foregoing pontoon boats, wherein the storage box is a rotationally molded storage box.

Supported embodiments include any of the foregoing pontoon boats, wherein at least one of the modular boat seats includes a footrest.

Supported embodiments include any of the foregoing pontoon boats, wherein at least one of the modular boat seats includes a support structure having an internal compartment for storing the footrest.

Supported embodiments include an apparatus, a system, a method and/or means for implementing any of the pontoon boats or portions thereof.

Supported embodiments include an apparatus comprising: a modular boat seat having a frame, an upper support structure, a lower support structure, and means for connecting the lower support structure and the upper support structure to the frame, wherein the frame includes a pair of vertical members and plurality of connecting members with the connecting members attaching to the vertical members to form the frame, and wherein the upper support structure and the lower support structure include means for supporting the weight of a person sitting thereon.

Supported embodiments include a system, a method and/or means for implementing the foregoing apparatus or portions thereof.

Supported embodiments include a method for assembling a modular boat seat, the method comprising: attaching a pair of vertical members to a plurality of connecting members to form a frame; forming an upper support structure and a lower support structure from outdoor sling mesh fabric; and mounting the upper support structure and the lower support structure within the frame.

Supported embodiments include the foregoing method, further comprising: forming a molded seat support, a pair of molded armrests, and a molded storage compartment; and connecting the molded seat support, the molded armrests, and the molded storage compartment to the frame.

Supported embodiments include any of the foregoing methods, further comprising: attaching a footrest to the lower support structure.

Supported embodiments include any of the foregoing methods, further comprising: forming a molded storage box; and attaching the molded storage box to the frame.

Supported embodiments include an apparatus, a system, and/or means for implementing any of the foregoing methods or portions thereof.

Supported embodiments include a kit for forming a modular boat seat, the kit comprising: a frame; an upper support structure; a lower support structure; and a pair of attachment mechanisms; wherein the frame includes a pair of vertical members and plurality of connecting members for attaching to the vertical members to form the frame; wherein the upper support structure and the lower support structure include outdoor sling mesh fabric; and wherein the pair of attachment mechanisms can connect the upper support structure and the lower support structure to vertical members to connect the upper support structure and the lower support structure to the frame.

Supported embodiments include an apparatus, a system, a method and/or means for implementing the foregoing kit or portions thereof.

Supported embodiments can provide various attendant and/or technical advantages in terms of improved efficiency and/or savings with respect to the elimination of "cut and sew" cushions that are not durable on pontoon boats, attract mildew, and/or become moldy. Supported embodiments, additionally, eliminate the use of vinyl coverings that are not sunlight resistant and/or have colors that fade from sunlight exposure.

Supported embodiments eliminate joints in "cut and sew" cushions that allow foam to absorb water and/or require a long time to dry. Supported embodiments eliminate cushions that feel like sitting on a wet sponge. Supported embodiments can eliminate the use of foam cushions that attract animals that chew and make nests in such foam cushions.

Supported embodiments include modular boat seats that do not need to be covered and protected like vinyl cushions, the include sling fabric that dries faster than conventional vinyl fabrics, and/or that are more durable than vinyl.

Supported embodiments include modular boat seats that are essentially maintenance free. Supported embodiments include ventilated modular boat seats, so that users are not "hot and sticky", as compared to users of conventional vinyl seats.

Supported embodiments include modular boat seats that can be cleaned through pressure washing. Such modular boat seats can use fabrics that are available in many types of colors and designs.

Supported embodiments include rotationally molded boxes that can prevent leakage, as compared to conventional dry storage. Supported embodiments include a seat back that has a top edge that can provide an armrest.

Supported embodiments include a lounge seat that includes a sliding leg rest.

Supported embodiments include modular design configurations that allow for the mounting on most pontoon boats and reduces stock keeping units (SKUs) for dealer inventory.

The detailed description provided above in connection with the appended drawings is intended as a description of examples and is not intended to represent the only forms in which the present examples can be constructed or utilized.

It is to be understood that the configurations and/or approaches described herein are exemplary in nature, and that the described embodiments, implementations and/or examples are not to be considered in a limiting sense, because numerous variations are possible. The specific processes or methods described herein can represent one or more of any number of processing strategies. As such, various operations illustrated and/or described can be performed in the sequence illustrated and/or described, in other sequences, in parallel, or omitted. Likewise, the order of the above-described processes can be changed.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. A pontoon boat comprising:

a pair of pontoons, a deck positioned above the pontoons, and a plurality of modular boat seats on the deck, wherein each modular boat seat has a frame, an upper support structure, a lower support structure, and piping, wherein the frame includes a pair of vertical members and plurality of connecting members with the connecting members attaching to the vertical members to form the frame, wherein the upper support structure and the lower support structure include outdoor sling mesh fabric, wherein the piping connects the upper support structure and the lower support structure to vertical members to connect the upper support structure and the lower support structure to the frame; and wherein at least one of the modular boat seats includes a pair of molded armrests.

2. The pontoon boat of claim 1, wherein the outdoor sling mesh fabric is made from a plurality of PVC-coated synthetic fibers including at least one of a polyester fiber, an acrylic fiber, an olefin fiber, or a PVC fiber.

3. The pontoon boat of claim 1, wherein the pair of molded armrests are rotationally molded armrests.

4. The pontoon boat apparatus of claim 1, wherein at least one of the modular boat seats includes a storage box.

5. The pontoon boat of claim 1, wherein the storage box is a rotationally molded storage box.

6. The pontoon boat of claim 1, wherein at least one of the modular boat seats includes a footrest.

7. A pontoon boat comprising:

a pair of pontoons, a deck positioned above the pontoons, and a plurality of modular boat seats on the deck, wherein each modular boat seat has a frame, an upper support structure, a lower support structure, and a pair of sling rails, wherein the frame includes a pair of vertical members and plurality of connecting members with the connecting members attaching to the vertical members to form the frame, wherein the upper support structure and the lower support structure include outdoor sling mesh fabric, wherein the sling rails connect the upper support structure and the lower support structure to vertical members to connect the upper support structure and the lower support structure to the frame; and wherein at least one of the modular boat seats includes a pair of molded armrests.

8. The pontoon boat of claim 7, wherein the outdoor sling mesh fabric is made from a plurality of PVC-coated synthetic fibers including at least one of a polyester fiber, an acrylic fiber, an olefin fiber, or a PVC fiber.

9. The pontoon boat of claim 7, wherein the pair of molded armrests are rotationally molded armrests.

10. The pontoon boat of claim 7, wherein at least one of the modular boat seats includes a storage box.

11. The pontoon boat of claim 7, wherein the storage box is a rotationally molded storage box.

12. The pontoon boat of claim 7, wherein at least one of the modular boat seats includes a footrest.

* * * * *